US005160247A

United States Patent [19]

Kandpal

[11] Patent Number: 5,160,247

[45] Date of Patent: Nov. 3, 1992

[54] THRUST BEARING FOR REFRIGERATION COMPRESSOR

[75] Inventor: Tara C. Kandpal, Tecumseh, Mich.

[73] Assignee: Tecumseh Products Company, Tecumseh, Mich.

[21] Appl. No.: 764,885

[22] Filed: Sep. 24, 1991

[51] Int. Cl.[5] ..... F04B 35/04

[52] U.S. Cl. ..... 417/415; 417/572; 384/243; 384/420; 384/590; 384/618; 92/72; 74/44

[58] Field of Search ..... 417/415, 902, 572; 384/243, 420, 425, 590, 618; 92/72; 74/44

[56] References Cited

U.S. PATENT DOCUMENTS 1,373,929 4/1921 Wisdom ..... 384/618

3,281,192 10/1966 Daubenfeld ..... 384/590

4,632,644 12/1986 Fritchman ..... 417/415

4,869,649 9/1989 Hattori et al. ..... 417/238

*Primary Examiner*—John J. Vrablik

*Assistant Examiner*—David L. Cavanaugh

*Attorney, Agent, or Firm*—Baker & Daniels

[57] ABSTRACT

A hermetic compressor including a hardened cylindrical pin bearing disposed through the crankshaft permits a line contact between the crankshaft and bearing hub for a more efficient compressor. The pin bearing reduces friction while increasing compressor efficiency. In one embodiment, the hardened steel pin is constructed in two parts permitting rotation within the crankshaft. In another embodiment, hardened metal sleeves surround the cylindrical bearing pin allowing.

16 Claims, 2 Drawing Sheets

THRUST BEARING FOR REFRIGERATION COMPRESSOR

BACKGROUND OF THE INVENTION

The present invention relates generally to a hermetic compressor and more particularly to small refrigeration compressors used in household appliances. An area of interest in the compressor art is how to construct a more efficient and quieter compressor. The efficiency of a compressor is expressed as an energy efficiency ratio (EER) which is measured by dividing the BTU per hour output of the compressor by the power consumption under standard running conditions. The higher the EER the greater the efficiency.

One area that has received attention is that of mechanical friction within the compressor. The crankshaft of compressors generally rotates about a vertical axis and therefore requires journalling within a frame and bearings to position and confine its rotation. A thrust bearing is used to bear the weight of the crankshaft and motor parts. In the past, these bearings have generally been of a plain or oil film type, either having two machined surfaces rubbing together or one or two hardened washers. Another type of bearing in use is a ball bearing system. A disadvantage of ball bearings is that they increase the noise of the compressor and also increase the cost of the compressor as well.

SUMMARY OF THE INVENTION

According to the present invention, it is found that friction is reduced by the use of a bearing pin pressed through the crankshaft sliding upon the bearing hub of the compressor in a line contact.

In the preferred embodiment of the invention, a compressor having a rotating crankshaft within a support frame or cylinder block includes an elongated bearing or pin disposed within the crankshaft, that rotatably bears against the support frame or cylinder block. The bearing pin made out of hardened steel provides a line contact against the bearing hub of the support thereby reducing friction as compared to previous compressor bearings.

In an alternative embodiment of the invention, two hardened pins are rotatably disposed within the crankshaft and maintain a line contact with the support or cylinder block.

In another form of the invention, the hardened pin disposed through the crankshaft has two sleeves or rollers, one on each side of the crankshaft. These rollers allow a greater opportunity for rolling movement between the pin and bearing hub on the cylinder block.

A particular advantage of the compressor of the present invention is that friction is minimized by having the contact between the bearing hub and bearing comprise a line contact where the pin and bearing hub meet.

The invention, in one form thereof, provides a refrigeration compressor for use in refrigerators. The compressor includes a cylinder block mounted within a housing and having a piston reciprocatingly disposed within a cylinder. A crankshaft means for reciprocating the piston in the cylinder is provided that is journalled in a vertical bore of the cylinder block and has an upper end extending upwardly above a bearing hub. The bearing hub has an upper end face defining the vertical bore upon which an elongated bearing, extending transversely through the crankshaft means, is supported. A rotor is secured onto the crankshaft concentric with a stator mounted in the cylinder block.

In one aspect of the previously described form of the invention, the elongated bearing is a one piece thrust pin disposed through and perpendicular to the axis of the crankshaft means. In this preferred embodiment, the thrust pin is a hardened steel pin having a hardness of between 73 and 78 on the Rockwell hardness scale.

In accordance with an alternative embodiment of the invention, the elongated bearing is a thrust pin having two rotatable sleeves. The sleeves rotate about opposite ends of the thrust pin on opposite sides of the crankshaft. The thrust pin is pressed through the crankshaft.

In accord with another embodiment of the invention, the thrust bearing is comprised of a plurality of elongate bearing pins rotatably received within the crankshaft. These pins, which rotate within the crankshaft, extend beyond the crankshaft outer diameter creating a line contact with the bearing hub upper end face surface.

According to a further aspect of the invention, an oil lubrication means communicating oil to the bearing from the oil sump. This oil lubrication means comprises a spiral groove on the crankshaft opening to the bearing and an oil pumping means in communication with the spiral groove for pumping oil from the oil sump through the spiral groove to the bearing.

According to a further aspect of the invention, the invention comprises a housing having mounted therein a compressor unit having a support frame. The support frame has a bore surrounded by an end face. The compressing unit has a crankshaft with an elongate bearing extending through the crankshaft and supported by the end face of the frame. The crankshaft is connected between the compressor unit and a motor having a rotor and stator.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
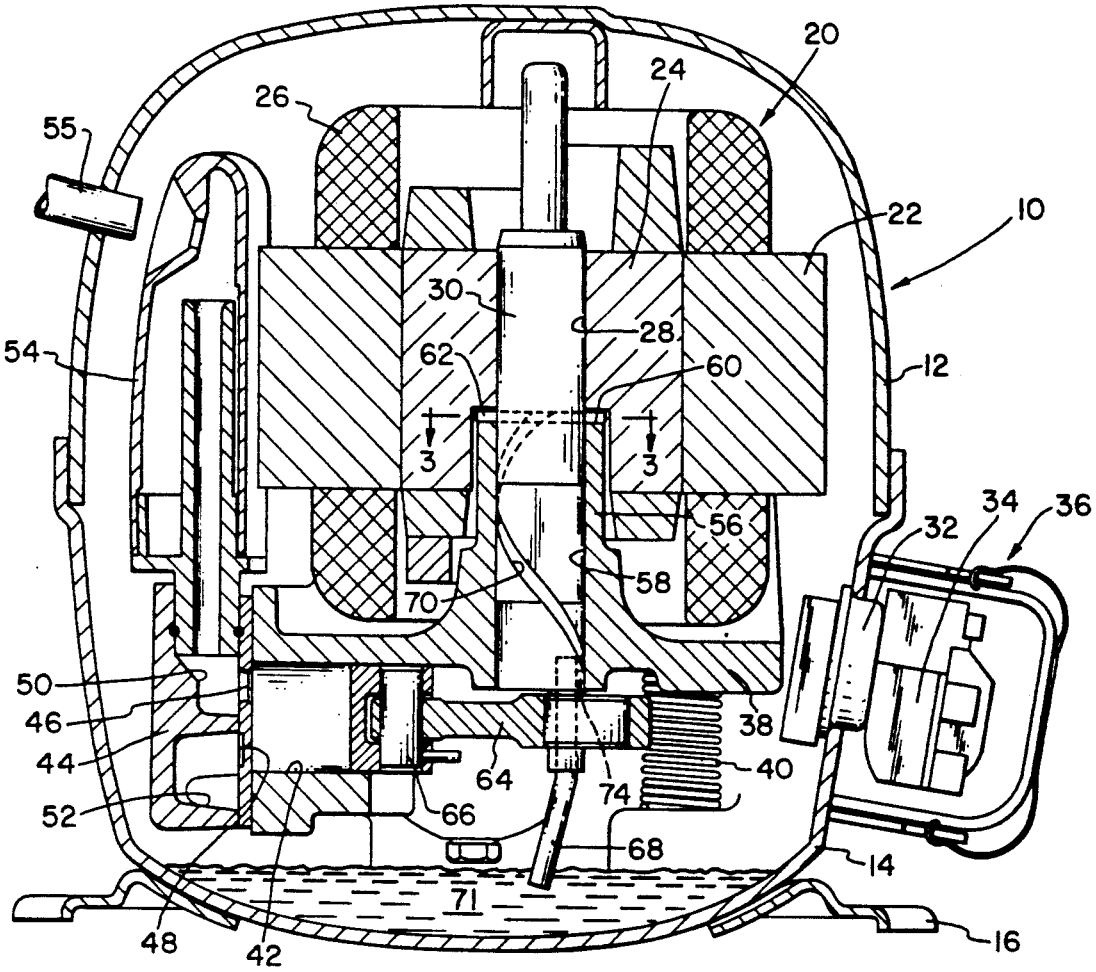
FIG. 1 is a longitudinal sectional view of a compressor of the type to which the present invention pertains.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown a compressor having a housing generally designated as 10. The housing has a top portion 12 and a lower portion 14 that are hermetically secured together as by welding or brazing. A flange 16 is welded to the bottom of housing 10 for mounting the compressor.

Located inside the hermetically sealed housing 10 is a motor generally designated at 20 having a stator 22 and rotor 24. The stator 22 is provided with windings 26. Stator 22 is secured to the support frame or cylinder block 38 by means of screws. The rotor 24 has a central aperture 28 provided therein into which is secured crankshaft 30 by an interference fit. A hermetic terminal 32 is provided on bottom portion 14 of the compressor for connecting motor 20, through cluster block 20*a*, to a source of electrical power. As shown in FIG. 1, a motor relay 34 is connected over terminal cluster 32 and a terminal shield 36 covers both terminal cluster 32 and motor relay 34.

Within housing 10 is mounted a support frame or cylinder block 38 resiliently suspended within housing 10 by suitable spring mounts such as compression spring 40 connected to cylinder block 38 and bottom portion 14 of compressor 10. Although only one spring is shown, it is to be understood that a number of springs are provided at proper positions to support cylinder block 38 within housing 10

Cylinder block 38 has a horizontally extending cylinder bore 42 which is sealed off at the end adjacent to housing 10 by cylinder head 44 including suction valve 46, discharge valve 48, suction plenum 50 and discharge plenum 52. Connected to cylinder head 44 is a suction muffler 54. A suction tube 55 permits refrigerant to enter compressor from a refrigerant system (not shown). Discharge plenum 52 is in communication with a discharge tube (not shown) leading out of housing 10. From the center of cylinder block 44 extending upwardly is a bearing hub 56 defining a vertical bearing bore 58. Bearing hub 56 has an end face 60 facing upwardly on bearing hub 56.

Crankshaft 30 is journalled for rotation within vertical bearing bore 58. As shown in FIG. 1, and in accordance with the present invention, an elongate bearing 62, such as a pin, extends transversely through the crankshaft 30. If desired, bearing pin 62 can be press fit in crankshaft 30. Bearing 62 rides upon endface 60 of bearing hub 56. A connecting rod 64 is attached to the end of crankshaft 30 that extends through bearing bore 58. Connecting rod 64 is attached to piston pin 66 that fits within cylinder bore 42, and causes piston 66*a* to reciprocate within cylinder bore 42 as crankshaft 30 rotates.

The reciprocating compressor described herein provides a lubrication system for lubricating the components of the compressor including the crankshaft 30 and bearing 62. An oil pickup tube 68 is disposed within crankshaft 30 and is in communication with spiral groove 70 extending around the outer surface 72 of crankshaft 30. Oil pickup tube 68 is partially immersed in an oil sump 71. Spiral groove 70 is in communication with a radial oil passage 74 (see FIG. 1). Radial oil passage 74 allows oil to travel to groove 70 and through groove 70 to bearing pin 62.

Figure 2:
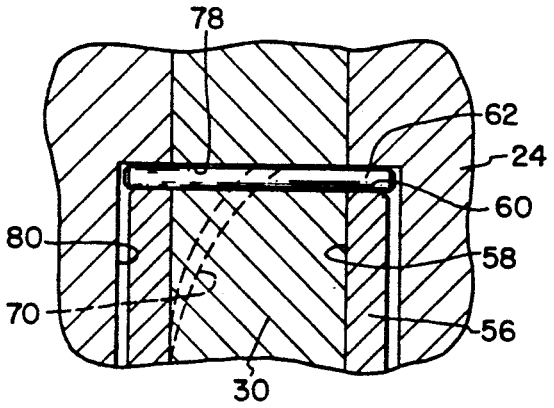
FIG. 2 is an enlarged fragmentary sectional view of the compressor of FIG. 1 particularly showing the bearing pin of the present invention.
Figure 3:
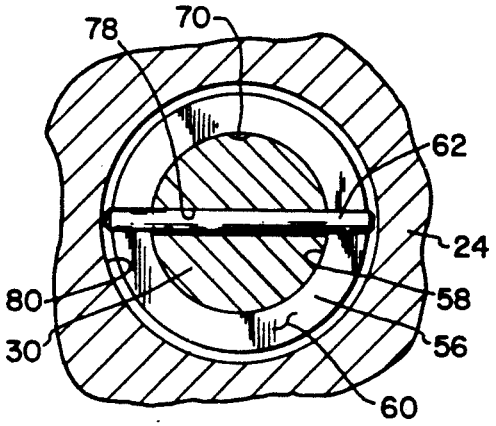
FIG. 3 is a view of the present invention taken along the line 3—3 of FIG. 1 and viewed in the direction of the arrows.

FIG. 2 shows bearing pin 62 disposed within crankshaft 30 resting upon endface 60 of bearing hub 56. Bearing 62 is preferably made from a steel pin hardened to a value of between 73 and 78 on the Rockwell hardness scale. Preferably pin 62 is smoothed and polished before being press fit into hole 78 in crankshaft 30.

In operation, the bearing pin 62 forms a line contact with endface 60. This line contact of minimal bearing area increases the efficiency of the compressor. Also during operation, oil pickup tube 68 will provide a flow of oil through radial oil passage 74 and through spiral groove 70 into communication with bearing pin 62 and end face 64, thereby reducing friction even further.

Figure 4:
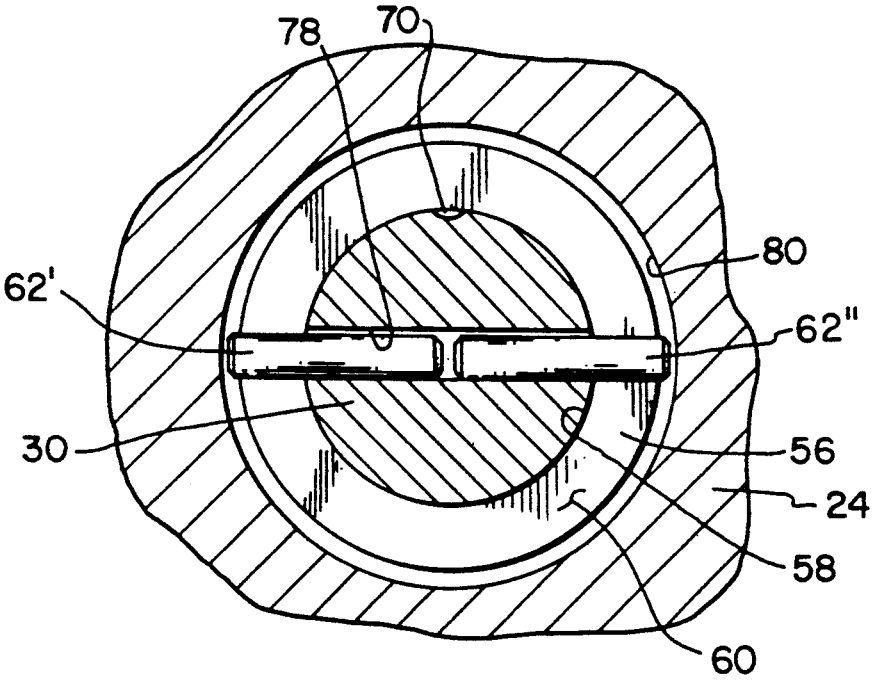
FIG. 4 is an enlarged transverse sectional view of an alternate embodiment of the bearing of the present invention.

FIG. 4 shows an alternate embodiment of the present invention where bearing 62 is composed of two hardened steel pins 62' and 62'' rotatably disposed within hole 78 in crankshaft 30. In this embodiment, a line contact is formed between pins 62' and 62'' and endface 60 just as in the preferred embodiment. In this embodiment, the two pins extend out of the crankshaft and are held in place by an inner face 80 of rotor 24.

Figure 5:
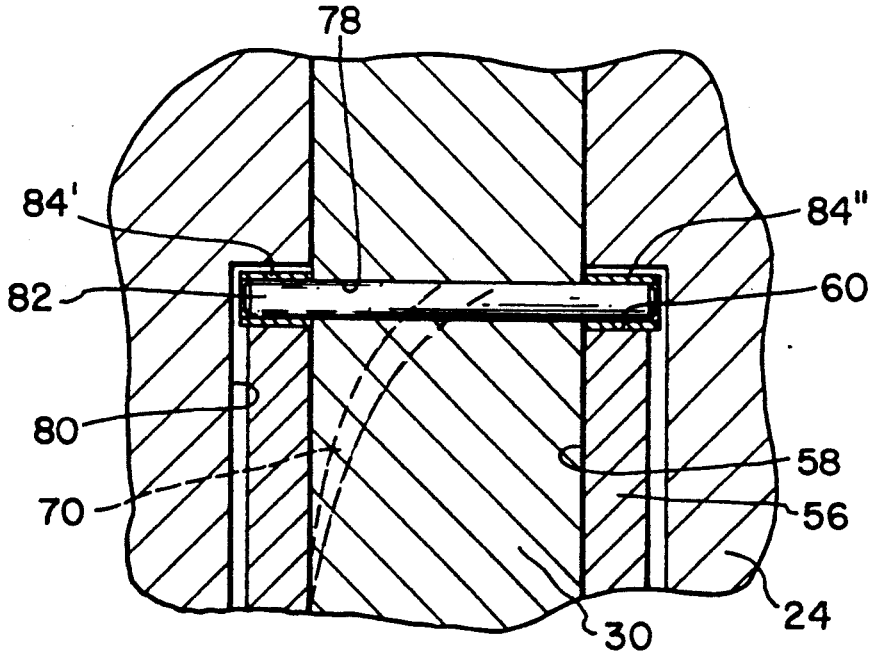
FIG. 5 is an enlarged fragmentary sectional view of a further alternate embodiment of the present invention.

FIG. 5 shows an another alternate embodiment of the invention where bearing 62 comprises a pin 82 inserted within hole 78 of crankshaft 30. Pin 82 has sleeves 84' and 84'' rotatably disposed on opposite sides of pin 82 extending through crankshaft 30. Sleeves 84' and 84'' create the line contact upon which crankshaft 30 bears against endface 60. Sleeves 84' and 84'' and pin 82 are hardened to a value of between 73 and 78 on the Rockwell hardness scale.

It will be appreciated that the foregoing description of various embodiments of the invention is presented by way of illustration only and not by way of any limitation and that various alternatives and modifications may be made to the illustrated embodiments without departing from the spirit and scope of the invention.

What is claimed is:

1. A refrigeration compressor comprising:

a housing;

a cylinder block mounted within said housing and having a cylinder therein;

a piston reciprocatingly disposed within said cylinder;

a stator mounted on said cylinder block;

a bearing hub on said cylinder block defining a vertical bore, said bearing hub having an upper end face around said vertical bore;

a crankshaft means for reciprocating said piston in said cylinder, said crankshaft means journalled in said vertical bore and having an upper end extending upwardly above said bearing hub;

a rotor secured on said crankshaft upper end concentric with said stator; and an elongate bearing extending transversely through said crankshaft means, said bearing being supported upon said end face.

2. The compressor of claim 1 in which said bearing is a one-piece thrust pin disposed through and perpendicular to said axis of said crankshaft means.

3. The compressor of claim 2 in which said thrust pin is a hardened steel pin having a hardness of between 73 and 78 on the Rockwell scale.

4. The compressor of claim 2 in which said bearing is a thrust pin having two rotatable sleeves, said sleeves rotating around opposite ends of said pin on opposite sides of said crankshaft means.

5. The compressor of claim 4 in which said thrust pin is hardened.

6. The compressor of claim 4 in which said pin is pressed through said crankshaft means.

7. The compressor of claim 1 in which said bearing is comprised of a plurality of elongate bearing pins rotatably received in said crankshaft means.

8. The compressor of claim 1 in which said pins extend beyond crankshaft.

9. The compressor of claim 1 further comprising an oil sump and an oil lubrication means communicating oil to said bearing from said oil sump.

10. The compressor of claim 9 in which said oil lubrication means comprises a spiral groove on said crankshaft opening to said bearing and an oil pumping means in communication with said spiral groove for pumping oil from said oil sump through said spiral groove to said bearing.

11. A compressor comprising:

a housing;

a compressor unit mounted in said housing having a support frame, said support frame having a bore surrounded by an end face;

a motor mounted in said housing and having a stator and rotor;

said compressor unit having a crankshaft connected to said rotor; and an elongate bearing extending through said crankshaft and supported on said end face.

12. The compressor of claim 11 in which said bearing is a one-piece thrust pin disposed through and perpendicular to said axis of said crankshaft.

13. The compressor of claim 12 in which said thrust pin is a hardened steel pin having a hardness of between 73 and 78 on the Rockwell scale.

14. The compressor of claim 11 in which said bearing is a thrust pin having two rotatable sleeves, said sleeves rotating around opposite ends of said pin on opposite sides of said crankshaft.

15. The compressor of claim 14 in which said thrust pin is hardened.

16. The compressor of claim 11 in which said bearing is comprised of a plurality of elongate bearing pins rotatably received in said crankshaft.

* * * * *